US005738255A

United States Patent [19]

Wilms

[11] Patent Number: 5,738,255

[45] Date of Patent: Apr. 14, 1998

[54] COAT HANGER

[76] Inventor: Heinrich Wilms, Balkenkampsweg 21, 49328 Melle, Germany

[21] Appl. No.: 855,739

[22] Filed: May 8, 1997

Related U.S. Application Data

[62] Division of Ser. No. 596,854, Feb. 5, 1996, abandoned.

[30] Foreign Application Priority Data

Mar. 16, 1995 [DE] Germany ..... 295 04 469 U
May 19, 1995 [EP] European Pat. Off. ..... 95107655

[51] Int. Cl.[6] ..... A47G 25/14

[52] U.S. Cl. ..... 223/92; 223/85

[58] Field of Search ..... 40/322; 223/88, 223/85, 92, 95; 340/572; 70/57.1

[56] References Cited

U.S. PATENT DOCUMENTS

| | | | |
|---|---|---|---|
| 1,448,256 | 3/1923 | Chidley | 223/85 |
| 1,501,000 | 7/1924 | Lane | 40/666 |
| 2,801,036 | 7/1957 | Klein | 40/322 |
| 3,967,766 | 7/1976 | Hart | 223/85 |
| 4,137,661 | 2/1979 | Johansson | 40/322 |
| 4,261,121 | 4/1981 | Coon | 40/666 |
| 5,022,571 | 6/1991 | Blanchard | 223/85 |
| 5,082,152 | 1/1992 | Chen | 223/85 |
| 5,102,019 | 4/1992 | Lam | 223/94 |
| 5,327,115 | 7/1994 | Swierzek | 340/572 |
| 5,345,071 | 9/1994 | DuMont | 340/572 |
| 5,367,289 | 11/1994 | Baro et al. | 70/57.1 |
| 5,423,139 | 6/1995 | Feldman | 40/322 |
| 5,511,701 | 4/1996 | Lam | 40/322 |
| 5,587,703 | 12/1996 | DuMont | 70/57.1 |

*Primary Examiner*—Bibhu Mohanty
*Attorney, Agent, or Firm*—Jordan and Hamburg

[57] ABSTRACT

A coat hanger is combined with an electronic, information storage device holding clothing-specific data into an operational unit and is provided with a fastening device, which can be unlocked preferably only by means of a special tool for fixing to the article of clothing at a variable distance.

24 Claims, 1 Drawing Sheet

COAT HANGER

This application is a continuation of application Ser. No. 08/596,854, filed Feb. 5, 1996, abandoned.

BACKGROUND OF THE INVENTION

The invention relates in general to the handling of textiles, particularly articles of clothing such as outer garments and relates, especially to a coat hanger.

Numerous embodiments of coat hangers are known and are in use. As a rule, the coat hangers comprise two arms and a central neck connecting these, in which there is a suspension hook. In the case of certain embodiments, a cross member, which extends below and at fight angles to the suspension hook between the two free ends of the arm of the coat hanger, is present in addition.

Aside from wooden coat hangers and those from metal wire, particularly iron or steel wire, predominantly plastic coat hangers are used as transporting coat hangers, on which articles of clothing are hung particularly in transporting vehicles, warehouses and retail businesses. After an article of clothing is purchased, only a few of these coat hangers, particularly plastic coat hangers are used again. The majority by far of the coat hangers is disposed of after a single use as a disposable item.

SUMMARY OF THE INVENTION

It is an object of the invention to a create coat hanger of the given type, which has a use beyond that of strictly a carrying function for the article of clothing and therefore is suitable as a reusable article.

Pursuant to the invention, this objective is accomplished owing to the fact that the coat hanger is combined with an electronic, information storage device holding clothing-specific data into an operational unit and is provided with a fastening device, which can be unlocked preferably only by means of a special tool and is intended to set a distance, which can be varied, from an article of clothing.

In the stricter sense, the electronic, information storage device which, pursuant to the invention, is assigned as functional part of the coat hanger, is a read-only memory (ROM) or a programmable memory (PROM), as usually formed by an integrated circuit, from which binary information, assigned to binary input signals, can be read by applying these binary input signals. Such memories are generally known as IC chips. The input of the data to be stored is accomplished here by techniques known to those skilled in the art.

The data, contained in the information storage device, primarily is clothing-specific data, such as the manufacturer, the size, the price and material of the article of clothing. However, additional data, specific for the coat hanger, such as the type, year of manufacture and material of construction of the coat hanger may also be entered. For the practical use of the unit formed by coat hanger and the information storage device, the detachable fastening device is formed as a clip or a seal, which makes a mechanical attachment to the article of clothing possible and can be detached, preferably, only by means of a special tool by authorized personnel, so that additional theft protection is provided in this way.

In this connection, the information storage device furthermore may comprise a circuit for triggering an alarm signal, to which responds an electronic monitoring device, for example, in the exit area of a department store and which emits an optical and/or acoustic warning signal. Such alarm circuits usually are based on magnetic, HF or microwave systems and their construction and use basically are known to the expert in this field, also with respect to the aspects of their deactivation, after a proper purchase has been made.

The ability to attach the coat hanger to the article of clothing at a variable distance, which is accomplished particularly over a rubber band or a similar elastic cord material, enables the article of clothing to be tried on before it is purchased in the business, without the fastening device having to be detached. When the article of clothing is removed from the coat hanger, the latter, which is held at the article of clothing by the fastening device, moves downwards towards the floor under the action of its own weight with elongation of the rubber band in proportion to its ability to stretch and to its length by a given amount of about 1 to 1.5 m, so that the trying on of the article of clothing is not hindered by the coat hanger, which, however, remains connected to the article of clothing. When the article of clothing, after having been tried on, is hung once again on the coat hanger, the extended rubber band retracts automatically because of its elasticity, so that the fastening device once again assumes a position close to the coat hanger, which it normally assumes when the article of clothing is on the coat hanger. Basically, however, it is also possible to detach the fastening device from the rubber band in such a manner, that the latter remains with its fastening on the coat hanger, which then, for the time being, is not used further, while the constructional unit, comprising the information storage device and the fastening device, remains on the article of clothing, which in such a case, for example, is offered for sale by the seller on a different, more expensive presentation coat hanger.

The electronic information storage device makes it possible for the customer to obtain the information in the memory by means of a suitable reading gun and a monitor already when the garment is being tried on. Additional labels for the information of the purchaser have become superfluous by these means. The reading gun, for example, may also be combined, for the trying on, with a counter, which is specific for the article of clothing, and records and stores the number of times a particular article of clothing has been tried on. When the article of clothing is purchased, the selling price of the article of clothing can be read from the memory at the cash register with a suitable reading gun and displayed.

The inventively constructed coat hanger simplifies not only the selection process, the trying on of and the payment for an article of clothing in the retail store, but also the verification of the goods received and the manufacture in general, since provisions are made within the scope of the invention that the information storage device is already attached by the manufacturer of the article of clothing to the associated coat hanger and fixed to the article of clothing by means of the fastening device, so that later on, if an appropriate reading gun is used, labor-intensive controls and labeling work need no longer have to be carried out in the warehouse and for making a sale. By means of such information storage devices and with the help of appropriate reading guns and control equipment, the in-house transport of articles of clothing, in the state in which they are connected with the associated coat hanger, can also be carried out rationally in bulk warehouses or in spacious distribution centers.

The coat hanger, constructed pursuant to the invention, is also readily suitable as a reusable coat hanger, since the data, which is specific to the article of clothing and contained in the information storage device, can be erased when it is no longer required and replaced by new data, or the coat hanger can be provided with a new memory device. The data, which is specific to the coat hanger and contained in the memory device, facilitates sorting and making the coat hanger available for a new use by taking up an appropriate article of clothing. Suitable auxiliary equipment, which records the data of the memory of the coat hanger and optionally passes it on as signals, is also used for these processes.

Basically, the principle of the invention can be applied to any coat hanger, irrespective of whether it consists of plastic, wood, metal wire or other different suitable materials. In particular, the application of the invention is not limited to newly manufactured coat hangers with a particular shape and to new articles of clothing; rather, coat hangers of various shapes, already in circulation or in use, can subsequently be equipped with the constructional units comprising the information storage device and in this manner converted to an inventive service unit, which consists of a coat hanger and an information storage device and which can find use generally not only in department stores and clothing stores, but also find general use, for example, in dry-cleaning operations and clothing hoppers.

From this point of view, the invention also comprises a constructional unit comprising the electronic information storage device and the fastening device as a label carrier for the articles of clothing or appropriately handled textiles in general. It replaces the conventional labels and can be used, preferably in conjunction with a coat hanger but also independently of this, as an independent unit.

Further distinguishing features and advantages of the invention arise out of the claims and the specification below in conjunction with the drawing, in which two embodiments of the object of the invention are illustrated diagrammatically.

In the Drawing:

FIG. 1 shows a perspective representation of an inventive coat hanger of plastic, and FIG. 2 shows a cross section through a coat hanger of plastic in the basic construction of FIG. 1, but with some slight modifications, in order to illustrate a modified embodiment.

DESCRIPTION OF THE PREFERRED EMBODIMENTS

Figure 2:
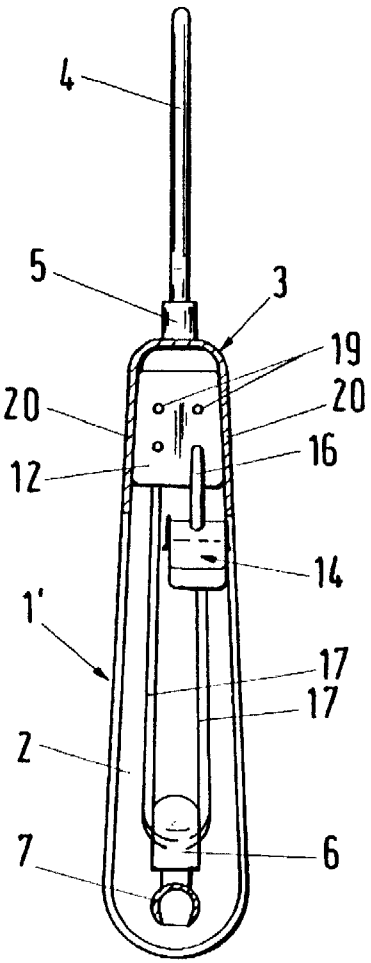

The coat hanger, shown in the drawing, is formed mainly from a molded plastic article, which is labeled 1 as a whole and is manufactured particularly by the injection molding method. The molded article 1 comprises, in a one-piece molded construction, two coat hanger arms 2 and a central coat hanger neck 3 connecting these arms, to the upper side of which neck a metal suspension hook 4 is fixed, so that it can swivel, over a one-piece beating bush 5, which is integrally molded to the neck 3 of the coat hanger 1. At their underside, the free end regions of the arms 2 of the coat hanger 1 have one-piece, integrally molded sleeves 6, which accommodate stems (not shown) of a cross member 7, which runs transversely to the suspension hooks 4 and is pressed by means of its stems firmly into the sleeves 6.

Figure 1:
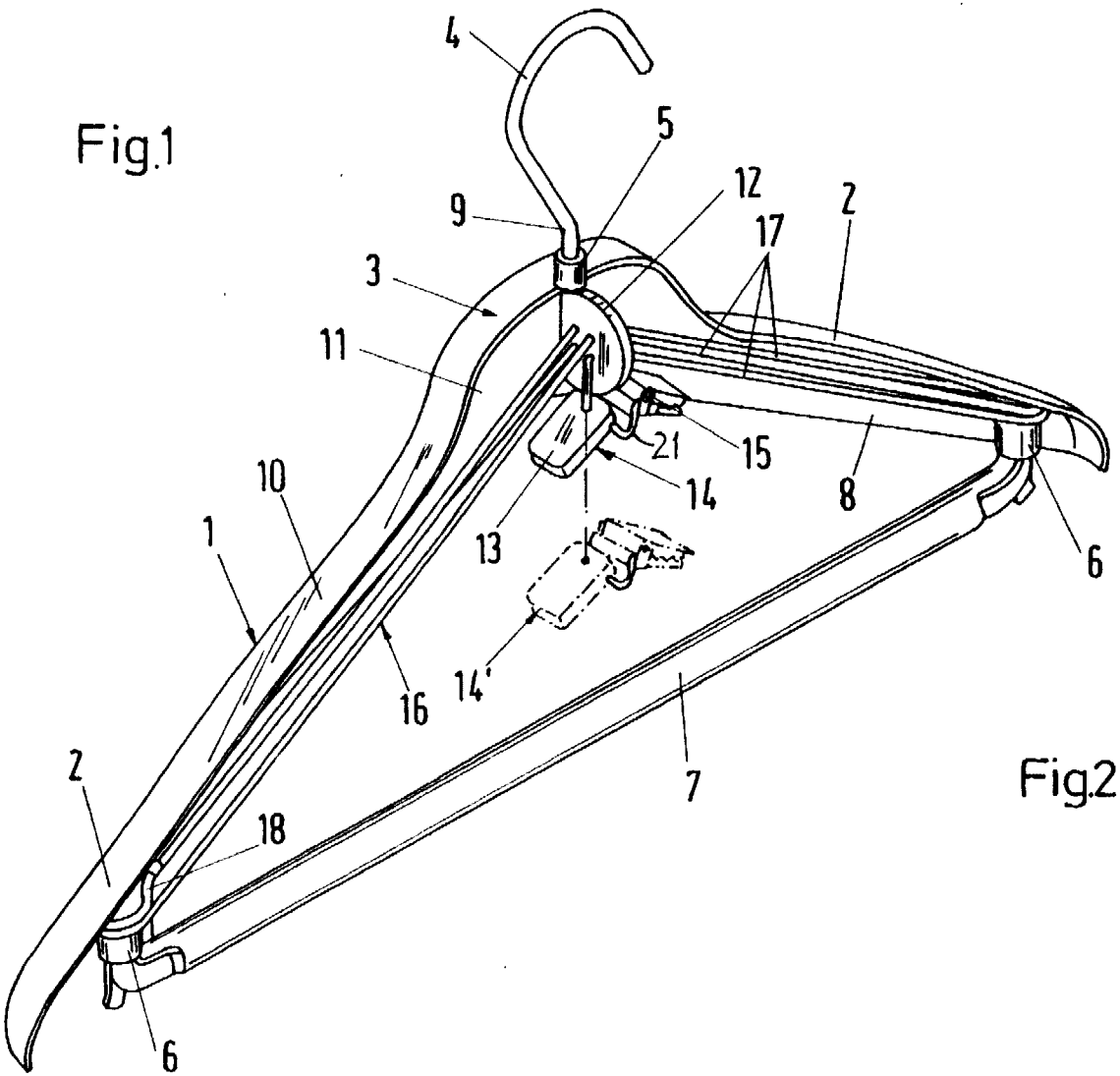

The cross section of the arms 2 and the neck 3 of the coat hanger 1 basically is L-shaped in the case of the example of FIG. 1, the long leg 8 of the L-shaped profile being directed downward essentially parallel to the longitudinal extent of the fastening shaft 9 of the suspension hook 4, while the upper side of the short leg 10 of the L-shaped profile forms the upper supporting surface for the article of clothing (not shown) and runs essentially at right angles to the long leg 8. The supporting surface for the article of clothing is completed in the well-known manner by the outer side of the L-shaped leg 8.

A central holding and guiding device 12 for an electronic information storage device 13 is inserted from the inside 11 of the profiled leg 8 into the neck 3 of the coat hanger. For this purpose, the leg 8 is provided with a longitudinal slot, into which an edge region of the holding device 12 is firmly inserted.

Because of the data, which is specific to the article of clothing and preferably also to the coat hanger and is stored in the information storage device 13, the latter, particularly an IC chip in a suitable housing, together with the coat hanger, forms a service unit and permits this service unit to be handled rationally and also permits the coat hanger to be used repeatedly.

In the case of the preferred example shown, the information storage device 13 forms a constructional unit 14 with a fastening device 15, which serves for the detachable fastening of the service unit, formed by the coat hanger and the information storage device 13, to an article of clothing. The constructional unit 14 includes a connecting member 21 which connects the information storage device 13 and the fastening device 15. The connecting element 21 may be a U-shaped clip which pivotally connects the information storage device 13 and the fastening device 15. In the case of the example, shown, the fastening device 15 has the shape of a clamp or clip of the type known, in principle, from suspenders. The clamping levers of such a fastening device enables an edge region of an article of clothing to be clamped securely. The fastening device can be detached, preferably, only by means of a special tool, in order thus to provide security against theft. For this purpose, the clip shown may be provided with a locking element, which blocks the two clamping levers of the clip in the clamped position to prevent opening, it being possible to remove or destroy this locking element only with a special tool.

The constructional unit 14 thus serves as a label carrier for the articles of clothing and is held by a rubber band 16 or a similar elastic cord element at a variable distance from the coat hanger or the molded article 1. The rubber band 16 is provided with an elastic fabric jacket and is supported at the molded object 1 along the arms 2 and the neck 3 of the coat hanger, running along the inside 11 of the profiled leg 8. One end of the rubber band 16, to which the constructional unit 14 is fastened, emerges at the guiding and holding device 12. In the case of the example shown, the rubber band is fastened to the housing of the information storage device 13.

The rubber band 16 has a length of about 1 to 2 m and is fixed in a multiple strand arrangement at the molded article 1 in such a manner, that it can extend and that the coat hanger 1, under the action of its own weight, can carry out a distancing motion towards the floor of about 1 to 1.5 m, when the article of clothing, with the constructional unit 14 fastened to it, is taken from the coat hanger 1. The individual strands 17 of the rubber band 16 basically are parallel to one another and in two adjoining planes above one another about reversing elements at the ends of the arms 2 of the coat hanger 1. The reversing elements are formed by the sleeves 6 of the arms 2 of the coat hanger. The individual strands 17 of the rubber band 16 can slide around the outer periphery of the sleeves 6. The end of the rubber band 16 is fixed by means of a loop 18 at one of the sleeves 6. The central holding and guiding device 12 is constructed as a bushing for guiding the individual strands 17 of the rubber band 16 in the mentioned, basic parallel alignment in two planes lying one above the other. For this purpose, the bushing 12 has four openings 19 (FIG. 2), which are disposed in the corner points of an imaginary square and through which the individual strands 17 of the rubber band 16 can move.

In a position close to the coat hanger, as indicated by solid lines in FIG. 1, the constructional unit 14 is at the underside of the bushing 12 and, with that, close to the molded article 1 with a suitable locking contact, which can easily be detached in case of need, in such a way that the information storage device 13 lies on one side of a central symmetrical plane of the coat hanger containing the fastening shaft 9 of the suspension hook 4. This position corresponds, in particular, to the state of the coat hanger when no article of clothing is hung on it. With this arrangement, the coat hanger can be detected through the plastic of the molded article 1 with suitable reading guns or detectors for data, emitted by the information storage device as identification signals, without interference by the metal (steel) of the suspension hook 4.

A position 14' of the constructional unit 14, which is somewhat removed from the molded article 1, is indicated by lines of dots and dashes in FIG. 1. This position corresponds approximately to one in which the constructional unit 14 is fastened by means of the fastening device 15 to the edge of an article of clothing. The position 14' is attained by pulling the rubber band 16 out of the bushing 12 with elastic elongation of the rubber band 16, this elongation becoming correspondingly greater, when the article of clothing is removed from the coat hanger, which then endeavors to fall downwards under the action of its own weight. The elongating rubber band 16 here maintains the bond between the constructional unit 14 and the coat hanger in order, when the article of clothing is hung on the coat hanger once again, to return the constructional unit 14 once again into the position 14 near the coat hanger or to the position 14' approximately near the coat hanger because of the elastic restoring force. The outer fabric jacket of the rubber band 16, because of the elastic limit formed by it, prevents overextension and tearing of the rubber during the elongation or extension movements of the rubber band 16.

In the case of the modified embodiment of FIG. 2, the plastic molded article 1' has a hollow or U-shaped profile, which is open at the bottom and forms the arms 2 and neck 3 of the coat hanger 1. Slots in the two U-shaped legs 19 of the hollow profile accommodate the bushing 12, the adjoining edges of which are adapted to the alignment of the U-shaped leg 19. In other respects, this embodiment corresponds to that of FIG. 1, as is made clear by the use of the same reference numbers for the same or similar components.

The construction of the molded plastic article 1' with a hollow or U-shaped profile, which is open at the bottom, provides the possibility that the constructional unit 14 or at least the information storage device 13 is accommodated completely in a position close to the coat hanger in the cavity in the neck 3 of the coat hanger 1. Moreover, the possibility exists here of closing off the underside of the cavity in the region of the neck 3 of the coat hanger 1 by an appropriately shaped, detachable cover (not shown), in order to prevent easy access to the constructional unit 14 or to the information storage device 13. At the same time, such a cover can find use as carrier for the constructional unit 14 and for the holding and guiding device 12 of the rubber band, including, if necessary, its outer reversing device 6, and as such be pushed subsequently into and locked with existing coat hangers without any conversion.

As an alternate embodiment, the information storage device 13 may consist of an IC chip embedded in a plastic composition, for example, such as a credit card or a check card. In such a case, the coat hanger part of the connecting element 21 facing the information storage device 13 is also cast as an insert in the plastic composition of the information storage device 13 so that this would constitute an integral connection thereby. In such a case, the two elements 13 and 15 could be bent or swiveled elastically relative to one another.

As a further alternate embodiment, the label carrier can also be used as an independent unit independently of a coat hanger. Thus the label carrier consisting of the construction unit 14 with the information storage device 13 and the fastening device 15 can be detachably fastened to an item of clothing or textiles without using a hanger. Such label carrier can perform all of the functions of the label carrier as previously described in detail in the specification but without being attached to a hanger. For example, the label carrier can be used to include clothing-specific data, such as the manufacturer, the size, the price and material of the article of clothing. As in the prior embodiment, the information storage device further may include a circuit for triggering an alarm signal which responds to an electric monitoring device, for example, in the exit area of a department store and which omits an optical and/or acoustic warning signal. The electronic information storage device could also make it possible for the customer to obtain the information in the memory by means of a suitable reading gun. As in the prior embodiment, the detachable fastening device may be formed as a clip or a seal which makes a mechanical attachment to the article of clothing possible and can be detached, preferably only by means of a special tool, by authorized personnel so that additional theft protection is provided in this way.

What is claimed is:

1. A clothing hanger for hanging clothing which is to be tried on by a wearer comprising a hanger unit on which said clothing is adapted to be hung, said hanger unit including an electronic information storage means storing clothing specific data, said hanger unit also including fastening means adapted to be fastened onto the clothing hung on the hanger and operable to enable the clothing to be removed from the hanger and to be moved away from the hanger to try-on positions for trying on of the removed clothing by a wearer while said clothing remains fastened to said fastening means.

2. A clothing hanger according to claim 1 wherein said fastening means includes a constructional unit, said electronic information storage means being disposed on said constructional unit, said hanger unit including a hanger structure on which said clothes are adapted to be hung, said constructional unit with its electronic information storage means being removable from said hanger structure and moveable relative to said hanger structure to said try-on positions.

3. A clothing hanger according to claim 2 wherein said constructional unit has a retracted position juxtaposed to said hanger structure, said fastening means including an elongated resilient means connecting said constructional unit to said hanger structure, said resilient means having a first length when said constructional unit is in said retracted position, said resilient means having a second length when said constructional unit is in said try-on positions, said second length being greater than said first length.

4. A clothing hanger according to claim 2 further comprising a suspension hook having a fastening shaft, said fastening shaft being mounted on said hanger structure, said hanger having a central plane of symmetry which passes through said fastening shaft and in which said hanger arms are disposed on opposite sides of said central plane of symmetry, said constructional unit being moveable relative to said hanger structure from a retracted position to a plurality of said try-on positions, said information storage device being juxtaposed to said hanger structure and being disposed on one side of said central plane of symmetry when said constructional unit is in said retracted position.

5. A clothing hanger according to claim 2 wherein said hanger structure comprises a molded plastic article which includes said neck and said hanger arms, said neck and said hanger arms each having an inverted generally U-shaped configuration such that said neck and said arms having a cavity within the U-shaped configuration, said constructional unit being moveable relative to said molded article from a retracted position to a plurality of said try-on positions, said information storage device being completely disposed in said cavity of said neck when said constructional unit is in said retracted position.

6. A clothing hanger according to claim 5 further comprising a cover removably mounted on said neck for closing off said cavity in said neck.

7. A clothing hanger according to claim 3 wherein said resilient means comprises an elongated resilient element and an elastic fabric jacket over said resilient element for limiting the extension of said resilient element.

8. A clothing hanger according to claim 3 wherein said hanger structure includes a neck and two hanger arms extending divergently from opposite sides of said neck such that one half of said neck and one hanger arm are disposed on one side of a bisecting transverse hanger plane and the other half of said neck and the other one of said hanger arms are disposed on the opposite side of said bisecting hanger plane, a generally flat central guide disposed at said neck generally parallel to said bisecting transverse hanger plane, said resilient means comprising an elongated elastic member guided by said central guide.

9. A clothing hanger according to claim 8 wherein said central guide is detachably locked to said hanger structure.

10. A clothing hanger according to claim 8 wherein said hanger arms have end portions, guide elements on said end portions, said elongated elastic member extending along each hanger arm between said central guide and said guide elements, said elongated elastic member engaging and sliding on said guide elements as said construction unit moves between said retracted and said try-on positions.

11. A clothing hanger according to claim 10 wherein said elongated resilient member is a single elongated member having two ends, first connecting means connecting one of said ends to one of said guide elements and second connecting means connecting the other of said ends to said construction unit.

12. A clothing hanger according to claim 10 wherein said guide elements have a generally cylindrical configuration.

13. A clothing hanger according to claim 10 wherein said elastic member passes around said guide elements to reverse direction of said elastic member such that said elastic member which extends along each hanger arm has a plurality of elastic member portions extending along each hanger arm.

14. A clothing hanger according to claim 13 wherein said central guide has a plurality of spaced openings, said elastic member having a plurality of elastic member sections which pass through said spaced openings, one of said elastic portions extending along one arm being joined to another elastic portion extending along the other arm by one of said elastic member sections which pass through one of said openings in said central guide.

15. A clothing hanger according claim 13 wherein said elastic member portions extending along each hanger arm are substantially parallel to the respective hanger arm.

16. A clothing hanger according to claim 13 wherein there are at least three of said elastic member portions extending along each hanger arm.

17. A clothing hanger according to claim 3 wherein said elongated resilient means has a length of about 1 to 2 meters.

18. A clothing hanger according to claim 1 wherein said clothing is removable from said hanger and movable away from said hanger unit to said try-on positions a distance of about 1 to 1.5 meters.

19. A clothing hanger for clothing to be purchased by a potential purchaser comprising a hanger structure on which said clothing is adapted to be hung, moveable means which includes electronic information storage means storing clothing specific data, an elongated elastic means, first connecting means connecting said elastic means to said hanger structure, second connecting means connecting said elastic means to said moveable means, said moveable means further comprising attaching means attaching said moveable means to said clothing, said moveable means having a retracted position in which said moveable means is juxtaposed to said hanger, said clothing being adapted to be hung on said hanger structure when said moveable means is in said retracted position, said moveable means having try-on positions displaced from said retracted position and displaced from said hanger structure, said moveable means being moveable from said retracted position to said try-on positions by removing the clothing from said hanger structure and moving said clothing relative to said hanger structure to thereby stretch said elastic means, said moveable means being moveable from said try-on positions to said retracted position by re-hanging said clothing on said hanger structure as said elastic means contracts and pulls said moveable means back to said retracted position, said moveable means when in said try-on positions enabling said potential purchaser to try on said clothing while said moveable means continues to be attached to said clothing by said attaching means, whereby said clothing remains attached to said hanger structure while said moveable means is in said retracted position and said clothing is hung on said hanger and while said moveable means is in said try-on positions and said clothing is removed from and moved away from said hanger structure to said try-on positions.

20. A clothing hanger according to claim 19 wherein said attaching means is an anti-theft attaching means which locks onto said clothing and which precludes unlocking of said attaching means from said clothing by said potential purchaser of said clothing.

21. A clothing hanger according to claim 20 wherein said moveable means comprises connecting means connecting said anti-theft attaching means and said electronic information storage means to form a construction unit.

22. A clothing hanger for clothing to be purchased by a potential purchaser comprising a hanger structure on which said clothing is adapted to be hung, moveable means which includes electronic information storage means storing clothing specific data, fastening means, first connecting means connecting said fastening means to said hanger structure, second connecting means detachably connecting said fastening means to said moveable means to enable disconnection of said fastening means from said moveable means by said potential purchaser, said movable means further comprising attaching means attaching said movable means to said clothing, said moveable means having a first position in which said movable means is juxtaposed to said hanger, said clothing being hung on said hanger structure when said movable means is in said first position, said moveable means having try-on positions displaced from said first position and displaced from said hanger structure, said moveable means being moveable from said first position to said try-on positions by disconnecting said second disconnecting means and by removing the clothing from said hanger structure and moving said clothing relative to said hanger structure, said moveable means being movable from said try-on positions to said first position by re-hanging said clothing on said hanger structure, said movable means when in said try-on positions enabling said potential purchaser to try on said clothing while said movable means continues to be attached to said clothing, whereby said movable means remains connected to said clothing while said clothing is hung on said hanger and while said clothing is in said try-on positions is removed from and moved away from said hanger structure.

23. A clothing hanger according to claim 22 wherein said attaching means is in an anti-theft attaching means which locks on to said clothing and which precludes unlocking of said attaching means from said clothing by said potential purchaser of said clothing.

24. A clothing hanger according to claim 23 wherein said movable means comprises connecting means connecting said anti-theft attaching means and said electronic information storage means to form a constructions unit, said construction unit remaining attached to said clothing by said anti-theft attaching means while said clothing is in said first position and while in said try-on positions.

* * * * *